US007640769B1

(12) United States Patent
Clark

(10) Patent No.: US 7,640,769 B1
(45) Date of Patent: Jan. 5, 2010

(54) PORTABLE SELF-CONTAINED STORAGE APPARATUS FOR BIOLOGICALS

(76) Inventor: David M. Clark, 15051 Timber La., Monroe, MI (US) 48161

( * ) Notice: Subject to any disclaimer, the term of this patent is extended or adjusted under 35 U.S.C. 154(b) by 241 days.

(21) Appl. No.: 11/619,427

(22) Filed: Jan. 3, 2007

(51) Int. Cl.
*F25D 11/00* (2006.01)
*F25D 25/02* (2006.01)

(52) U.S. Cl. ..... 62/440; 62/381

(58) Field of Classification Search ..... 62/378, 62/440, 441, 457.1, 457.5, 457.9, 41; 221/92
See application file for complete search history.

(56) References Cited

U.S. PATENT DOCUMENTS 1,373,294 A * 3/1921 Bonzi ..... 62/441
2,091,292 A * 8/1937 Scurlock ..... 165/58
2,281,398 A * 4/1942 Walley ..... 62/382
2,536,287 A * 1/1951 Higgins et al. ..... 62/445
2,724,629 A * 11/1955 Atchison ..... 312/274
4,691,195 A * 9/1987 Sigelman et al. ..... 340/545.4
7,263,855 B2 * 9/2007 Meyer et al. ..... 62/371
2004/0177641 A1 * 9/2004 Kim ..... 62/441
2005/0138956 A1 * 6/2005 Okuda et al. ..... 62/441

* cited by examiner

*Primary Examiner*—Frantz F. Jules
*Assistant Examiner*—Cassey Bauer
(74) *Attorney, Agent, or Firm*—Jonathan Rigdon Smith, PC; Jonathan R. Smith

(57) ABSTRACT

A portable storage apparatus for biologicals has plural temperature-controlled compartments, each compartment having specially arranged shelves and sample trays or carousel bins. The device also has door-ajar annunciators and a built-in self-contained rechargeable power supply. Portability is enhanced by an optional free-standing roller base.

15 Claims, 8 Drawing Sheets

Section II-II'

Section IV-IV'

Section V-V'

Section VI-VI'

Section VII-VII'

PORTABLE SELF-CONTAINED STORAGE APPARATUS FOR BIOLOGICALS

DESCRIPTION

1. Field of Invention

This invention is in the field of preservation, transportation, storage, and retrieval of temperature-sensitive materials, more specifically biochemical materials.

2. Background of Invention

The decomposition of organic matter, like most chemical and biochemical reactions, is normally accelerated by increased temperature. Refrigeration has long been used to slow such reactions, and today basically the same technology that is used to preserve foodstuffs is used to preserve biologicals. Thus, the background technology for preservation of biologicals is food preservation. Desirable improvements in the preservation of biochemical materials emerge in a discussion of the similarities and differences between that and the preservation of food.

To keep perishable food safe for a few days, it is generally necessary only to maintain its temperature ten to fifteen degrees Celsius below room temperature. Even under these conditions, however, some thermal degradation still occurs. Some complex organic molecules, such as those responsible for flavors, degrade into less savory substances, and larger structures such as sols and cellular matrices responsible for the desirable texture of food may also break down more or less rapidly depending on the temperature at which they are stored.

Freezing of aqueous organic materials can slow such reactions to a greater extent than mere cooling, but the processes of freezing and later thawing can themselves damage complex molecules, sols, and tissue structures. Thus, the more careful the regulation of temperature in a proper range below room temperature and also above freezing, the better food is preserved for later consumption.

Biochemical materials stored for later use generally require more precise temperature control. This is because, generally speaking, biochemical compounds are large molecules and/or mechanically complex mixtures, the utility of which is dependent on maintenance of the exact original structure. Drugs, vaccines, living organisms and tissue samples, for example, are useless, even sometimes dangerous, unless preserved in nearly pristine condition. Small or rapid changes in temperature can create undesirable chemical byproducts or damage desirable sol or crystal structures.

Up to now, temperature control of biologicals has been accomplished merely by placing a more sensitive thermostat on a conventional refrigerator box. Such units have been made "portable" by loading them onto trucks and powering them with portable generators or large battery modules. These are neither amenable to rapid deployment, because of their weight, nor to use in locations where power is at a premium. They also lack the aesthetic appearance desirable for use in a hospital or medical practice setting.

Prior art sample preservation units therefore generally comprise a single box, that is, only one temperature zone, typically one that is maintained at approximately 5 degrees Celsius. If freezing of samples is needed, a second complete unit has been required.

Another aspect of biochemical materials which distinguishes them from ordinary perishables is the need for careful segregation of samples (to prevent cross-contamination) and cleanliness, and for easy and rapid organization and retrieval. Current practice is merely to place marked containers on a shelf within the refrigerated space. This works, of course, but better organization within the box is needed to reduce the potential for spillage and cross-contamination and to make it easier to find a specific item rapidly and accurately.

BRIEF DESCRIPTION AND OBJECTS OF INVENTION

The present invention is a storage apparatus for biologicals having the objects of improved versatility, portability, temperature stability, sample integrity, retrievability, and aesthetics. The improvement in versatility is provided by addition of a second cooled zone, e.g., a freezing zone. Improved portability is achieved by limiting the size and power requirements of the unit, which in turn is achieved by limiting the volume of air in the box to be temperature-controlled, which in turn is achieved by more compact arrangement of samples within the box. Optionally, a free-standing roller base is provided so that all of the contents may be made available within arm's reach in more than one room. Better temperature stability is achieved by minimization of surface area, an improved door seal, and by better isolation of the compressor from the box. This also reduces the power requirements by preventing compressor heat from getting back into the box. Digital external temperature set point control (high-low temperature lock) and door ajar annunciators provide additional stability.

Better sample integrity and retrievability is achieved by providing compartments specifically designed for alphanumeric or color-coded sequences of marked containers, such as vial boxes. One embodiment accomplishes this by utilizing a rectangular array of sliding trays, each tray of a width typical for individual vial boxes; another utilizes an array of bins arranged on a carousel, each bin of a width, depth, and height suitable for compact arrangement of individual vial boxes.

DETAILED DESCRIPTION OF INVENTION

Figure 1:
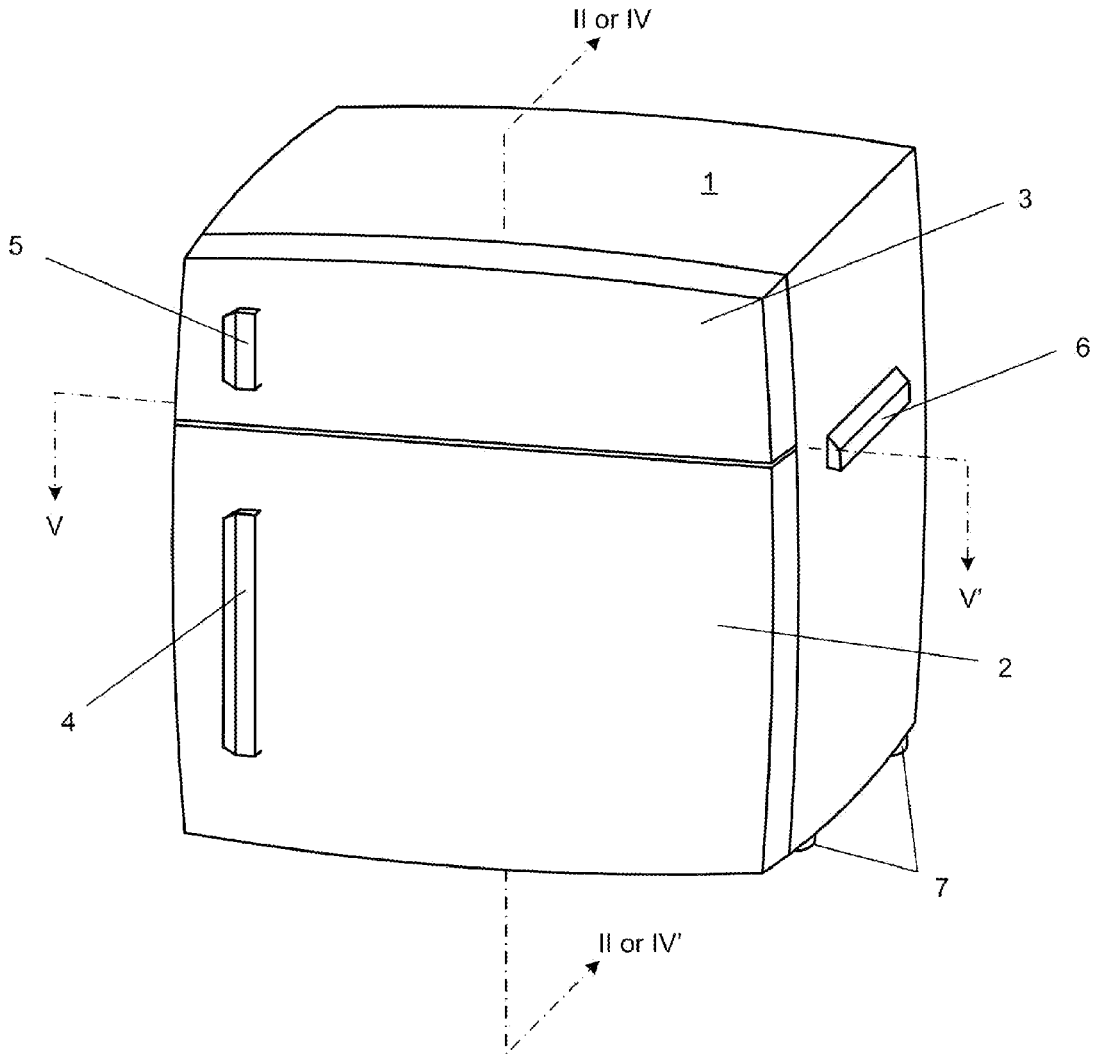
FIG. 1 is a perspective exterior view of the invention.

Referring now to the drawings, in which like features in each drawing are represented by like reference characters, FIG. 1 is a perspective exterior view of the both embodiments of the invention. A substantially cubical cabinet 1 contains the refrigerated compartments (not visible in this view) and the motor, compressor, and evaporator coils (not visible) normally associated with refrigeration equipment. The cubical shape provides the least possible surface area for a substantially rectangular cabinet, minimizing heat transfer and maximizing efficiency from the standpoint of surface-to-volume ratio.

The cabinet 1 also contains a self-contained power supply (not visible). The cabinet 1 may (as shown), but is not required to, have slightly rounded sides to enable more insulation to be interposed between the cabinet and the refrigerated compartments. A main door 2 and a freezer door 3, with handles 4 and 5, respectively, provide access to main and freezer compartments, respectively. A pair of handles 6 (one visible) provides for manual lifting of the entire invention.

Figure 2:
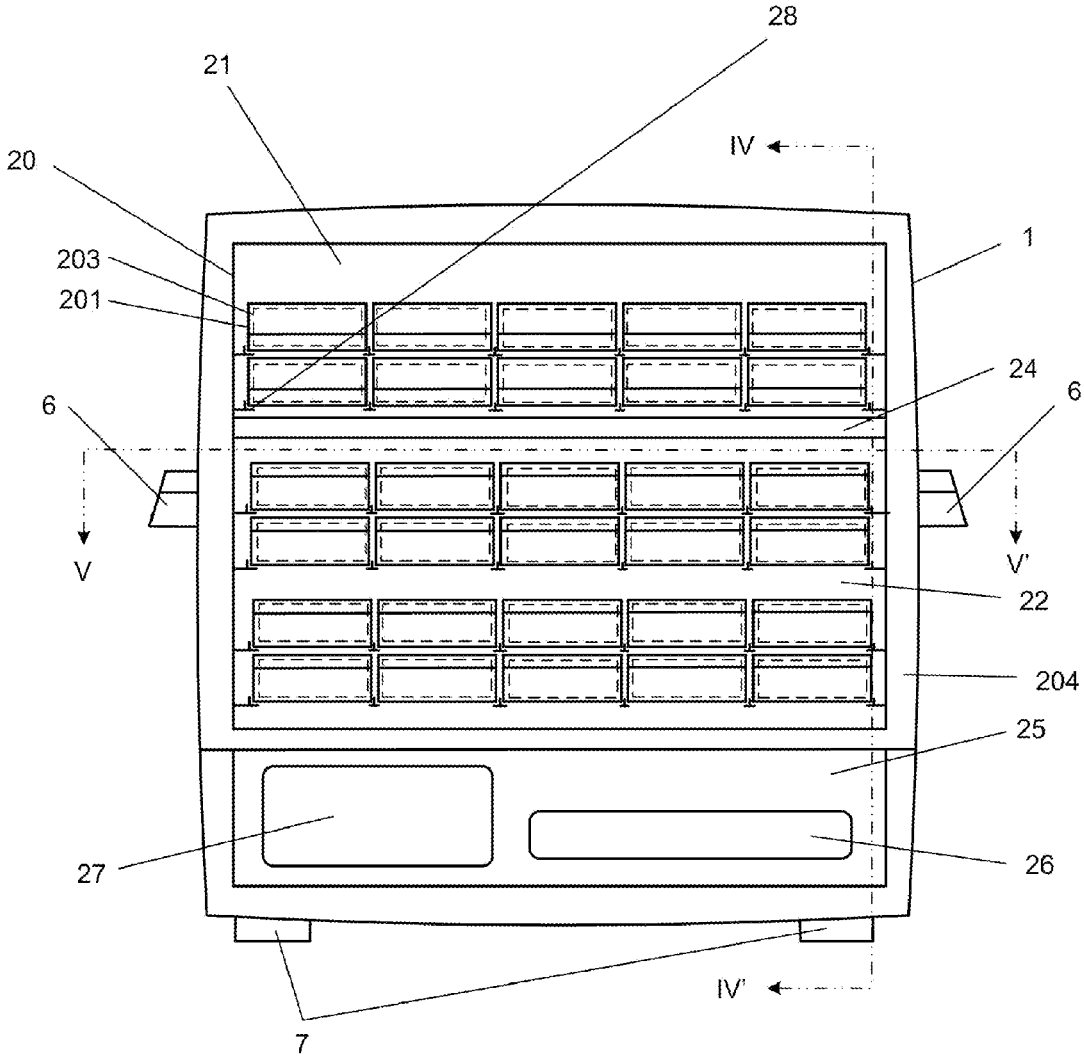
FIG. 2 is a front cross-sectional view of a first embodiment of the invention.
Figure 5:
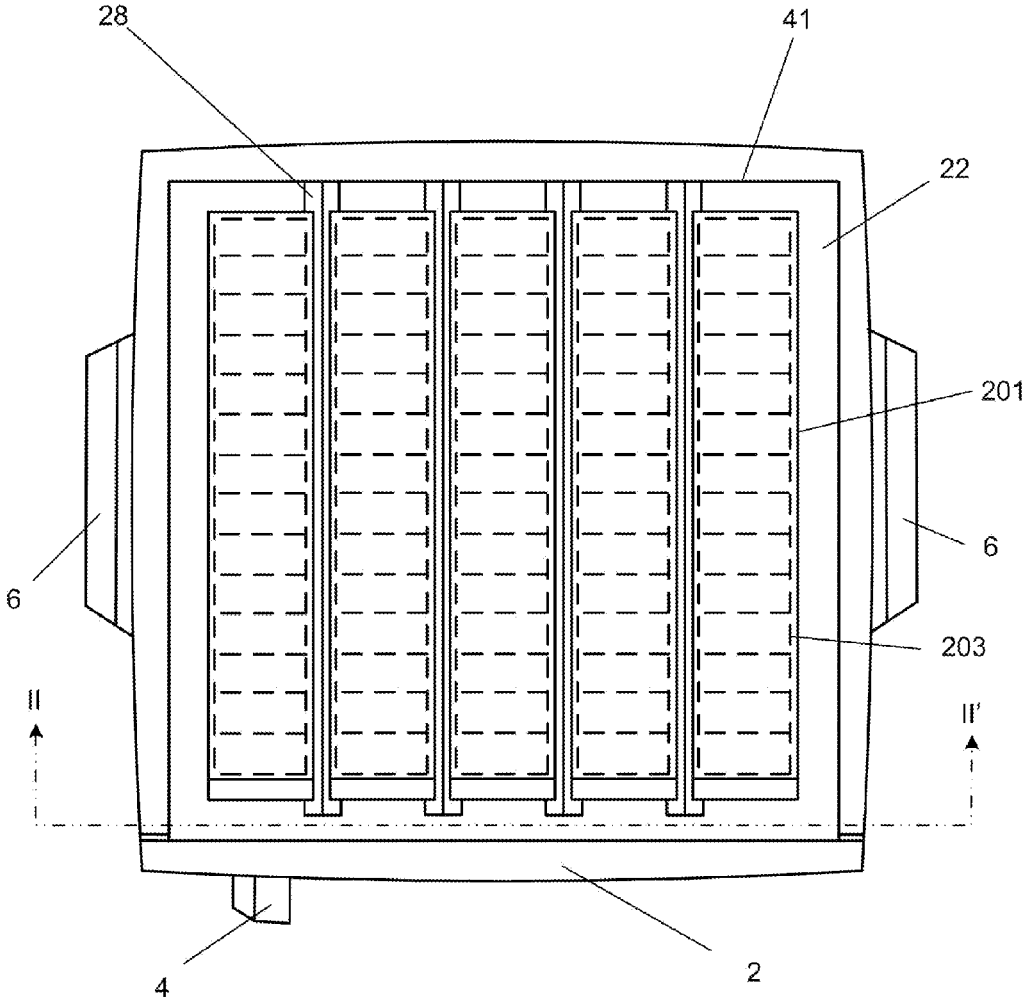
FIG. 5 is a top cross-sectional view of the first embodiment.

FIG. 2 is a front cross-sectional view of a first embodiment of the invention (vertical section II-II' or VI-VI'—see FIGS. 1 and 5). Cabinet 1 contains a thermally-insulated box 20, which is subdivided into an upper (freezer) compartment 21 and a main (chilled) compartment 22. The two subdivisions are insulated from each other by an insulated barrier 24. Below the box 20 is a power compartment 25 containing a battery pack 26 and a compressor 27 along with electronic regulating circuitry. High-efficiency insulation 204 (e.g., rigid foam) is interposed between box 20, cabinet 1, and power compartment 25. Also visible in this view are lifting handles 6 and feet 7.

Both the freezer compartment 21 and the chilled compartment 22 contain one or more tray support racks 28. (In the depicted embodiment, the freezer compartment 21 contains two such racks, and the chilled compartment 22 contains four such racks). Each rack 28 supports a plurality of elongate trays 201 (in the depicted embodiment, five) extending from the front of the box to the back. The trays 201 are of a width to accommodate the long dimension of a standard vial box 203 (shown in dashed lines to indicate environmental structure).

Figure 3:
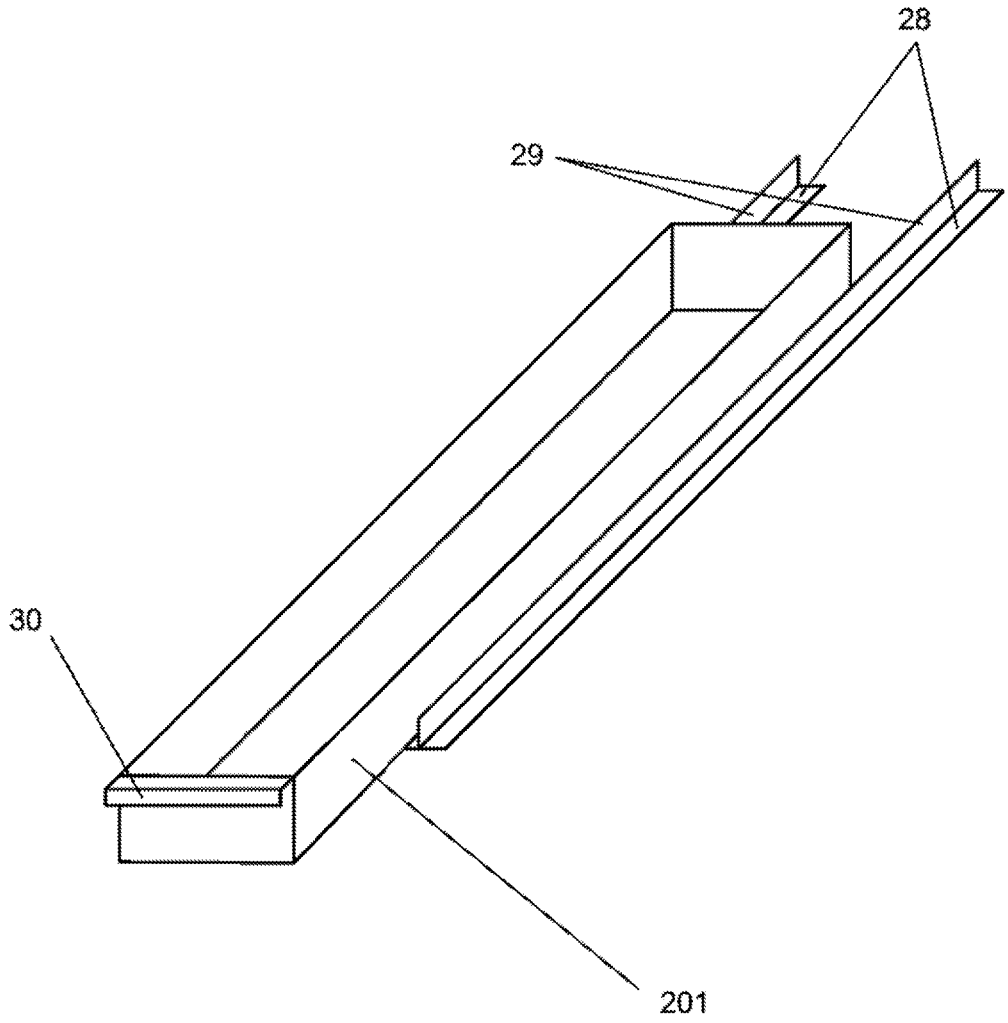
FIG. 3 is a perspective view of one of the trays.

FIG. 3 is a perspective view of one of the trays 201 and a corresponding portion of a rack 28, showing how each tray 201 is removably supported by a rack 28. Each rack 28 is subdivided by upward-extending flanges 29 snugly fitting the width of each tray 201. Thus each tray 201 may be accessed by pulling it forwardly out of the compartment. The trays 201 may be open at the top or optionally equipped with lids. Each tray may be appropriately labeled, such as on tray handle 30, to provide rapid access to a particular vial.

Figure 4:
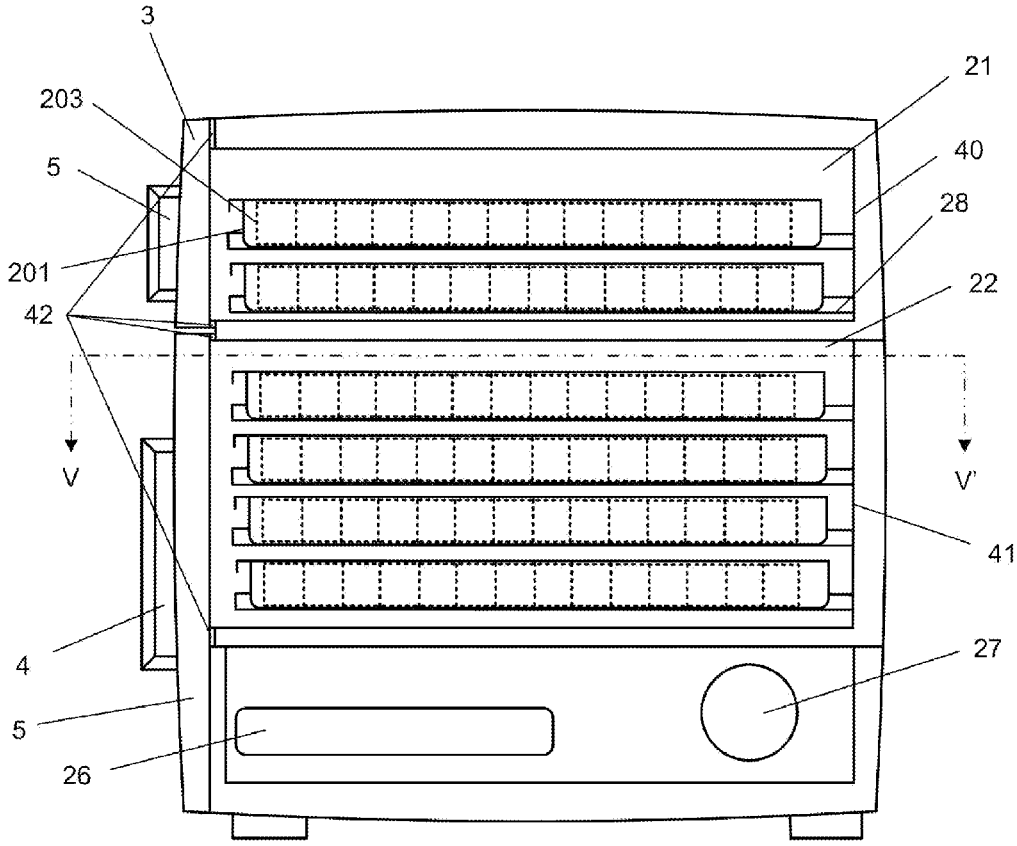
FIG. 4 is a side cross-sectional view of the first embodiment.

FIG. 4 is a side cross-sectional view of the first embodiment (vertical section IV-IV'—see FIG. 2). It shows elongate trays 201 holding vial boxes 203 on racks 28, which extend from near the front (left in this view) to the rear (right in this view) of compartments 21 and 22. The racks 28 are also fixed to the rear walls 40 and 41, respectively, of the compartments. Note also door seals 42.

FIG. 5 is a top cross-sectional view of the first embodiment through a horizontal plane (section V-V'—see FIGS. 1, 2 and 4). It shows the elongate trays 201 holding vial boxes 203 in chilled compartment 22, as seen from above. In the depicted embodiment, fourteen vial boxes can be placed in each tray, with 2×5×14=140 in the freezer compartment and 4×5×14=280 in the chilled compartment, for a total of 420. This Figure also shows a rack 28 attached to rear wall 41.

Figure 6:
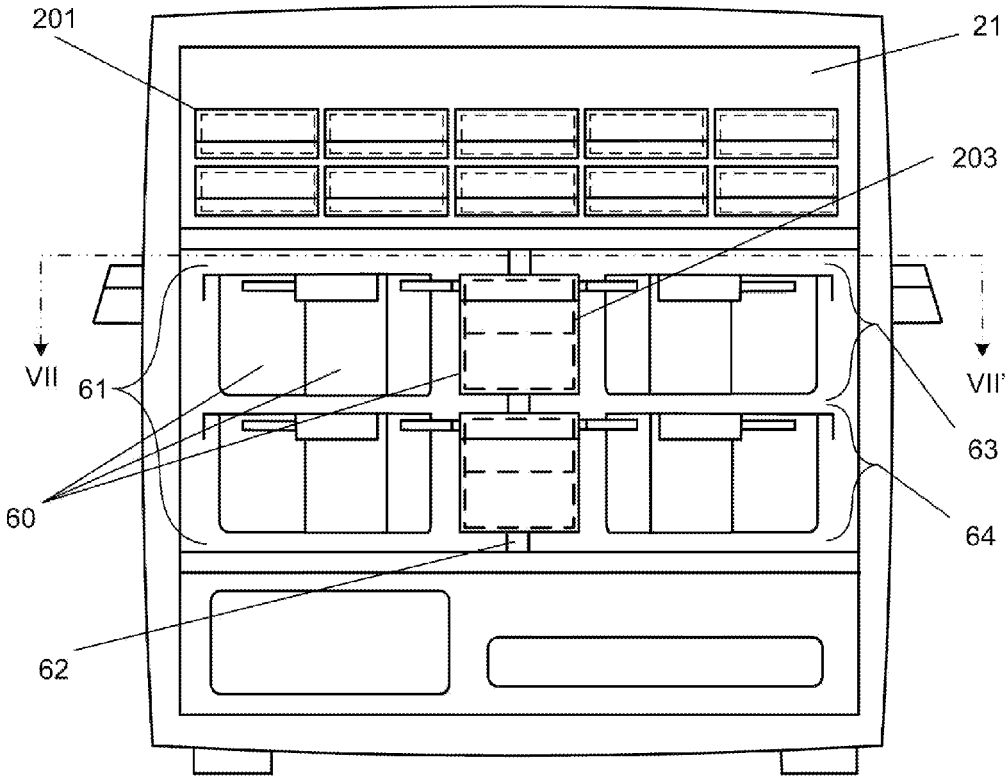
FIG. 6 is a front cross-sectional view of a second embodiment of the invention.

FIG. 6 is a front cross-sectional view of a second embodiment of the invention (vertical section VI-VI'—see FIG. 1). This second embodiment differs from the first only in the arrangement of vial box storage in the chilled compartment 22. Instead of employing elongate trays, this embodiment uses a plurality of bins 60 mounted on a carousel 61, capable of being revolved manually about a capstan 62. In this depiction, the carousel 61 comprises two levels 63 and 64, although any number may be employed to suit the dimensions selected for the compartment. Each carousel level 63 or 64 may be rotated independently of the other. Although trays 201 are shown in freezer compartment 21 in this depiction of the second embodiment, carousels may be utilized optionally in the freezer compartment 21 as well as in the chilled compartment 22.

Figure 7:
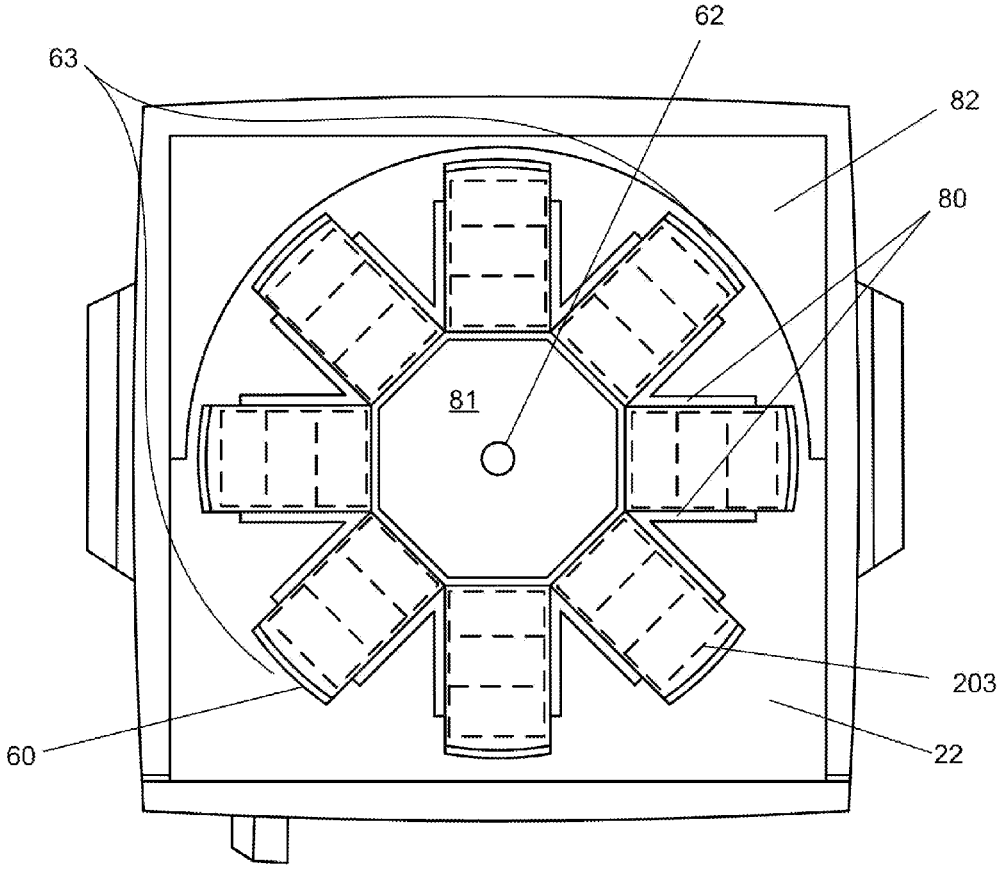
FIG. 7 is a top cross-sectional view of the second embodiment.

FIG. 7 is a top cross-sectional view of the second embodiment through a horizontal plane (section D-D'—see FIG. 6) more clearly showing the structure of the upper level carousel 63. Here, eight bins 60 can be seen arrayed radially about capstan 62. Each bin 60 is supported by a pair of capstan arms 80, which arms are affixed to an octagonal plate 81. Plate 81 in turn revolves on capstan 62. The bins may be slid radially outward on each pair of arms 80 so that any vial box 203 may be easily accessed. The vials may be open at the top or optionally equipped with lids.

Sixteen bins are depicted here, each having a capacity of six vial boxes (three horizontally and two vertically). This allows the chilled compartment in this depiction of the second embodiment to store up to 16×6=96 vial boxes. Each bin may be appropriately labeled to provide rapid access to a particular vial.

The carousel arrangement of the second embodiment creates more void space in the chilled compartment. Some of this space 82 may be utilized to provide additional battery capacity.

Figure 8:
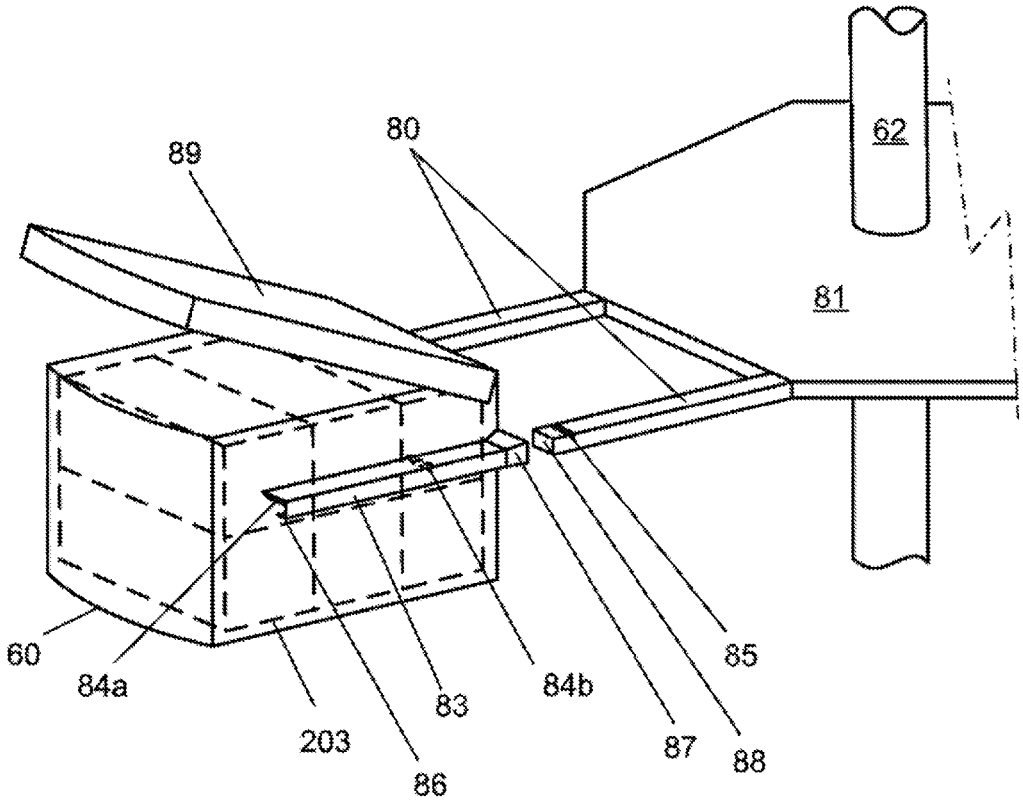
FIG. 8 is a perspective view of one of the bins of the second embodiment.

FIG. 8 is a perspective view of one of the bins 60 showing how it cooperates with a pair of capstan arms 80. Each bin has a pair of horizontal glides 83 (only one being visible) affixed to its sides which are dimensioned to slide snugly over, and be supported by, capstan arms 80. Male detents 84*a* or 84*b* within glide 83 can engage female detent 85 on arm 80 at either of two radial positions, depending on whether it is desired to hold bin 60 fully in against octagonal plate 81 or partially extended toward the compartment door. Optional bottom lip 86 on glide 83 prevents bin 60 from tipping forward on arm 80. Bin 60 may be completely removed from arms 80. An optional bell 87 (only one of two being visible) guides the end 88 of arm 80 into glide 83 when it is desired to reinstall bin 60 on arms 80. An optional lid 89 is provided on bin 60. This depiction of the second embodiment of the invention shows a bin capacity of six vial boxes 203 per bin.

The invention claimed is:

1. A storage apparatus for biologicals comprising:

A. a shaped cabinet, the cabinet having within it 1) at least one airtight and thermally-insulated compartment; each of the at least one compartments further having a) an open front and a back wall;

b) a thermally-insulated door;

the thermally-insulated door further comprising means for airtight and thermal sealing against the open front of the at least one compartment;

2) means for regulating temperature within each of the at least one compartments to a specific range of temperatures;

3) at least one bin within the at least one compartment;

4) at least one means for supporting the at least one bin, comprising a carousel rotatable about a vertical axial rotation means, about which the at least one bin may be revolved for access through said open front;

the at least one means for supporting the at least one bin further comprising i. a vertical axle manually rotatable about said vertical axis;

ii. at least one horizontal plate fixed to the axle, the plate having a perimeter;

iii. at least one pair of elongate parallel arms affixed to the perimeter and extending outwardly from the plate and perpendicularly to the axle, each arm having a shaped cross section;

iv. the carousel further comprising at least one means for repositioning the at least one bin relative to the carousel;

B. the at least one bin has a pair of parallel upper edges; and

C. the at least one means for repositioning the at least one bin relative to said carousel further comprises:

1) a pair of glides affixed horizontally to the pair of parallel upper edges of the at least one bin in parallel relation to one another, 2) each glide having a forward end and a rearward end, and 3) a shaped cross-section slidable upon each of the elongate parallel arms.

2. The apparatus of claim 1, wherein:

said means for regulating temperature further comprises

A. a means for drawing power from an external source of electric power;

B. a rechargeable means for storing electrical energy;

C. an electrically-powered refrigerating machine; and

D. means for measuring, indicating, and adjusting said specific range of temperatures.

3. The apparatus of claim 2, wherein:

said cabinet further comprises a utility compartment for containing said means for storing electrical energy and said electrically-powered refrigerating machine.

4. The apparatus of claim 3, further comprising means for manually moving the shaped cabinet wherein:

said at least one means for manually moving the shaped cabinet is taken from the list of A. lifting handles disposed on either side of said cabinet;

B. a handle attached to the top of said cabinet; and

C. a supporting base having rollers.

5. The apparatus of claim 4, wherein:

said shaped cabinet is substantially cubical, with slightly convex front, back, top and sides;

said at least one airtight and thermally-insulated compartment is mounted above said utility compartment; and said at least one airtight and thermally-insulated compartment and said utility compartment together form a cube within, and smaller in volume than, said shaped cabinet.

6. The apparatus of claim 5, in which:

said door has an open condition annunciator.

7. The apparatus of claim 1, wherein:

each of said elongate parallel arms has one-half of a mating detent molded thereinto; and each of said glides has at least one other half of a mating detent molded thereinto.

8. The apparatus of claim 7, wherein:

each of said glides has an enlarged rearward opening to permit easier sliding of said at least one bin onto said pair of arms.

9. The apparatus of claim 8, wherein:

said at least one bin further comprises

A. an open upper end;

B. rectilinear dimensions which are approximately integral multiples of the dimensions of a box intended for storage in said at least one bin.

10. The apparatus of claim 9, wherein:

said at least one bin has a lid.

11. A storage apparatus for biologicals, comprising:

A. a shaped cabinet, the cabinet having within it 1) at least one airtight and thermally-insulated compartment;

each of the at least one compartments further having a) an open front and a back wall;

b) a thermally-insulated door;

the thermally-insulated door further comprising means for airtight and thermal sealing against the open front of the at least one compartment;

2) means for regulating temperature within each of the at least one compartments to a specific range of temperatures;

3) at least one bin for a plurality of boxes;

4) at least one means for supporting the at least one bin, affixed to the inside of the compartment;

the at least one means for supporting the at least one bin further comprising a) means for repositioning the at least one bin relative to the means for supporting the at least one bin;

B. at least one means for manually moving the shaped cabinet; and wherein the means for regulating temperature further comprises C. a means for drawing power from an external source of electric power;

D. a rechargeable means for storing electrical energy;

E. an electrically-powered refrigerating machine; and

F. means for measuring, indicating, and adjusting said specific range of temperatures; and wherein the cabinet further comprises G. a utility compartment for containing the means for storing electrical energy and the electrically-powered refrigerating machine; and wherein the at least one means for manually moving the shaped cabinet is taken from the list of i. lifting handles disposed on either side of the cabinet, and ii. a handle attached to the top of the cabinet; and H. a supporting base having rollers;

and wherein the shaped cabinet is

I. substantially cubical, with slightly convex front, back, top and sides;

J. the at least one airtight and thermally-insulated compartment is mounted above the utility compartment; and K. the at least one airtight and thermally-insulated compartment and the utility compartment together form L. a cube within, and smaller in volume than, the shaped cabinet; and wherein the at least one bin for a plurality of boxes has i. an open upper end, and ii. rectilinear dimensions which are integral multiples substantially of the rectilinear dimensions of said boxes so that the pluralality of said boxes fit together slidingly within the at least one bin;

M. means for movably attaching the at least one bin to the means for supporting the at least one bin; and the at least one means for supporting the at least one bin comprises N. a carousel;

the carousel having a vertical axis fixed within the compartment, about which at least one bin may be revolved for access through said open front;

and wherein the carousel further comprises

O. a vertical axle manually rotatable about the vertical axis;

P. at least one horizontal plate fixed to the axle, the plate having a perimeter;

Q. at least one pair of elongate parallel arms affixed to the perimeter and extending outwardly from the plate and perpendicularly to the axle each arm having a shaped cross-section; and the means for movably attaching the at least one bin to the means for supporting the at least one bin further comprises 1) a pair of glides affixed horizontally to corresponding parallel upper edges of the at least one bin in parallel relation to one another, the glides each having a forward end and a rearward end, and 2) a shaped hollow cross-section geometrically similar to, and slidable upon, the pair of elongate parallel arms.

12. The apparatus of claim 11, in which:

said arms have one-half of a mating detent molded thereinto; and said glides have at least one other half of a mating detent molded thereinto.

13. The apparatus of claim 11, in which:

said door has an open condition annunciator.

14. The apparatus of claim 11, in which:

said glides have an enlarged rearward opening.

15. The apparatus of claim 11, in which:

said at least one bin has a lid.

* * * * *